US006981572B2

(12) United States Patent
Hedley

(10) Patent No.: US 6,981,572 B2
(45) Date of Patent: Jan. 3, 2006

(54) FOLDABLE ACCESS DEVICE

(75) Inventor: Robert Ian Hedley, Milbrodale Via Singleton (AU)

(73) Assignee: Hedweld Engineering Pty Ltd., New South Wales (AU)

( * ) Notice: Subject to any disclaimer, the term of this patent is extended or adjusted under 35 U.S.C. 154(b) by 0 days.

(21) Appl. No.: 10/359,971

(22) Filed: Feb. 7, 2003

(65) Prior Publication Data

US 2003/0173153 A1 Sep. 18, 2003

(30) Foreign Application Priority Data

Feb. 8, 2002 (AU) ..... PS0404/02

(51) Int. Cl.
*E06C 5/00* (2006.01)

(52) U.S. Cl. ..... 182/95; 182/127

(58) Field of Classification Search ..... 182/95, 182/84, 83, 85, 86, 89, 127; 280/166; 14/69.5; 192/97

See application file for complete search history.

(56) References Cited

U.S. PATENT DOCUMENTS

| | | | | |
|---|---|---|---|---|
| 2,531,263 | A * | 11/1950 | Fink et al. | 182/97 |
| 2,933,149 | A * | 4/1960 | Royal | 182/78 |
| 4,014,486 | A * | 3/1977 | Nelson et al. | 244/129.6 |
| 4,068,770 | A * | 1/1978 | Boehringer | 414/537 |
| 6,068,277 | A * | 5/2000 | Magnussen | 280/166 |

* cited by examiner

*Primary Examiner*—Alvin Chin-Shue
(74) *Attorney, Agent, or Firm*—McAfee & Taft

(57) ABSTRACT

An access device for providing access between a lower level and an upper level, the access device including a main body which includes a first body section and a body section pivotally connected to the first body section, said first section being mounted for pivotal movement about a main body fixed pivot mounting between an access position and a stowed position, a drive mechanism operable to cause movement of the first body section between the access and stowed positions, the first and second body sections being pivotally movable between an extended position in which they are disposed generally end to end and a retracted position in which they disposed generally side by side, and a control link assembly for controlling the movement of the first and second body sections between the extended and retracted positions.

1 Claim, 4 Drawing Sheets

FOLDABLE ACCESS DEVICE

The present invention relates generally to an access device for providing access between a lower level and an upper level.

In applicant's Australian Patent Specification No. 738307 (48282/97) there is described an access device of this general type and the contents of that specification are incorporated into the present specification by way of cross reference.

In the aforementioned Australian patent specification the access device comprises a main body in the form of a ladder or stairway which is mounted for pivotal movement about a fixed pivot mounting between an access position in which it enables access between the upper and lower levels and a stowed position in which a substantial part thereof is disposed above the fixed pivot mounting. The device further includes a drive mechanism operable to cause movement of the main body between the access and stowed positions. The drive mechanism includes a drive device and a drive link mechanism, the drive device comprising a linear actuator which includes a body portion pivotally mounted to a fixed structure and a drive member which can move in the direction of its longitudinal axis in a linear fashion relative to the body portion. The drive link mechanism includes a control drive link means mounted for pivotal movement about a drive control link fixed pivot mounting. The drive control link means is operatively connected to the drive member at a first connecting point, the fixed pivot mounting of the main body and the control link fixed pivot mounting being laterally disposed to the same side by longitudinal axis of the drive member. The link mechanism further includes coupling link means operatively connecting the main body to the control link means, the coupling link means being connected to the main body at a second connecting point, spaced from the fixed pivot mounting of the main body. The arrangement is such that actuation of the drive member causes linear movement thereof which causes the connection between the coupling link means and the main body to be displaced upwardly or downwardly to move the main body between the access position and the stowed position.

In Australian Patent Specification No. 738307 (48282/97) the main body includes an elongated member which as described above is in the form of a ladder or stairway which in the access position extends between the upper and lower positions with one end thereof being adjacent or resting on the lower level and the other end being adjacent the upper level. In this position, the main body is inclined with respect to a vertical axis and in the stowed position it is disposed generally upright above the upper level and preferably vertically above the main body pivot mounting point.

It is an object of the present invention to provide an access device in which the main body can be folded when in the stowed position.

According to one aspect of the present invention there is provided an access device for providing access between a lower level and an upper level, the access device including a main body which includes an upper section and a lower section which is pivotally connected to the upper section. The upper section is mounted for pivotal movement about an upper section fixed pivot mounting between an access position and a stowed position. The device further includes a drive mechanism operable to cause movement of the upper section between the access and stowed positions. The upper and lower body sections are pivotally movable relative to one another between an extended position in which they are disposed generally end to end and a retracted position in which they disposed generally side by side in a folded configuration. The device further includes a control link assembly for controlling the movement of the upper and lower sections between the extended and retracted positions, the control link assembly being movable in response to movement of the upper section between the access and stowed positions.

In one form the control link assembly may include a motion generating link operatively mounted for pivotal movement in response to movement of the upper section between the access and stowed positions. To this end, the motion generating link may be operatively connected to the drive mechanism. The control link assembly may further include a first transfer link assembly operatively connected to the motion generating link and being movable by the motion generating link in response to movement of the upper section between the access and stowed positions. The assembly further includes a coupling link pivotally mounted to the upper section of the main body and operatively connected to the first transfer link assembly and a second transfer link assembly operatively connected to the coupling link and the lower section of the main body.

Preferably, the first transfer link assembly includes a first link member having one end portion pivotally connected to upper section of the main body, and a second link member operatively connected to the first link member in spaced relation to the aforementioned one end thereof. Preferably, the first and second link members, the coupling link and a portion of the upper section of the main body form a typical four bar linkage. Preferably, the first link member is operatively connected to the motion generating link.

The coupling link may, in one form include two arms which extend away from one another from a junction region, one of the arms being connected to the second link member. Preferably, the two arms form a generally V-shaped configuration. There may further be provided a cross arm extending between the two arms in spaced relating from the junction region.

In one form the second transfer link assembly may include a third link member and a fourth link member, the third link member being connected between the coupling link and the fourth link member which in turn is operatively connected to the lower section of the main body.

Adjustable link means may be provided which is operatively connected between the coupling link and the lower section of the main body so as to urge it towards either the fully extended or retracted positions. The adjustable link means may be in the form of an elongated element, similar to a turnbuckle, one end of which is operatively connected to the lower section of the main body and the other end is operatively connected to the other arm of the coupling link.

Preferred embodiments of the invention will hereinafter be described with reference to the accompanying drawings, and in those drawings.

The access device of the invention can be mounted to a vehicle which may be an excavating vehicle as described in Australian Patent Specification No. 738307 (48282/97).

Figure 1:
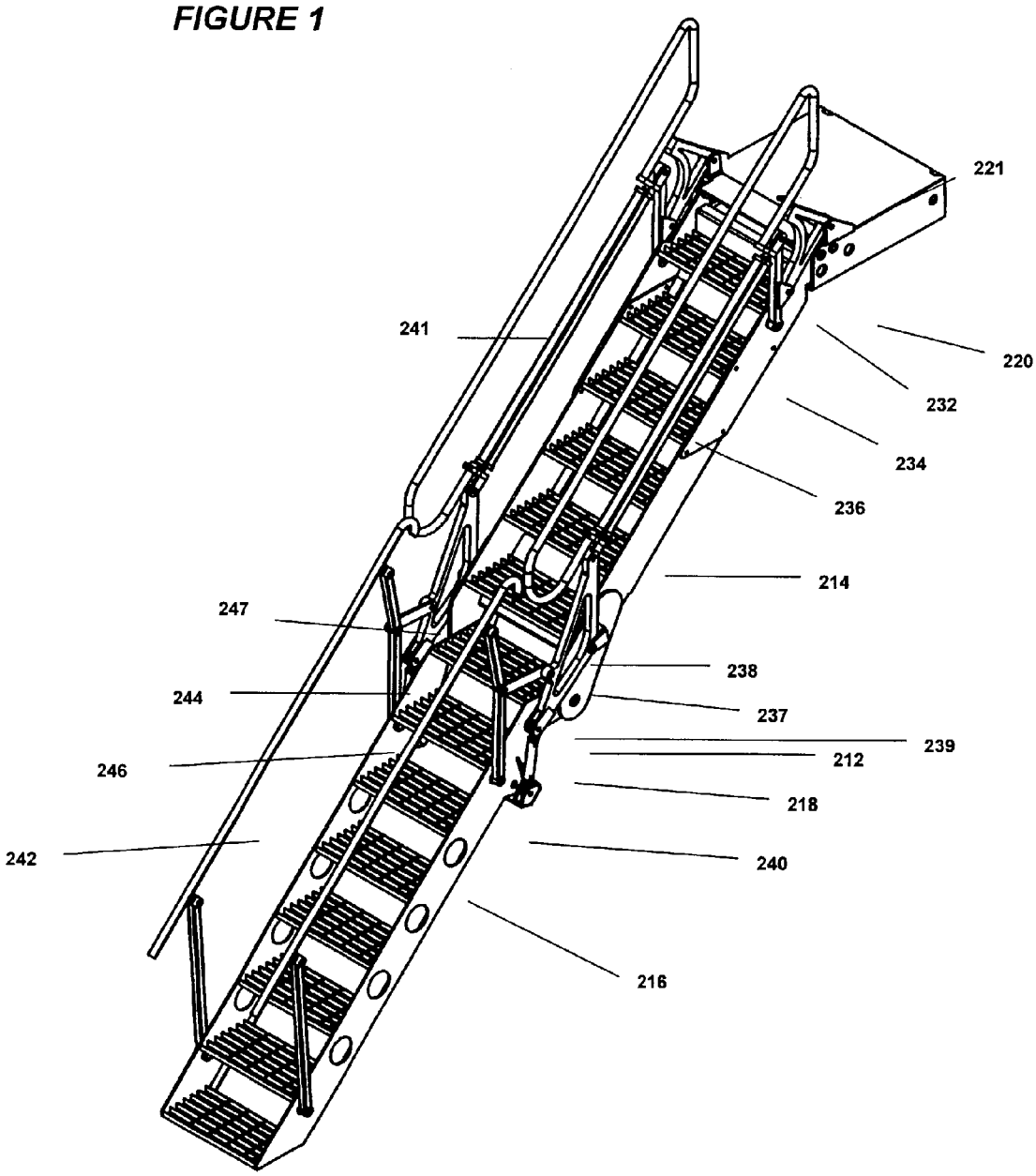
FIG. 1 is a schematic perspective view of an access device according to the invention in an access and extended position.
Figure 2:
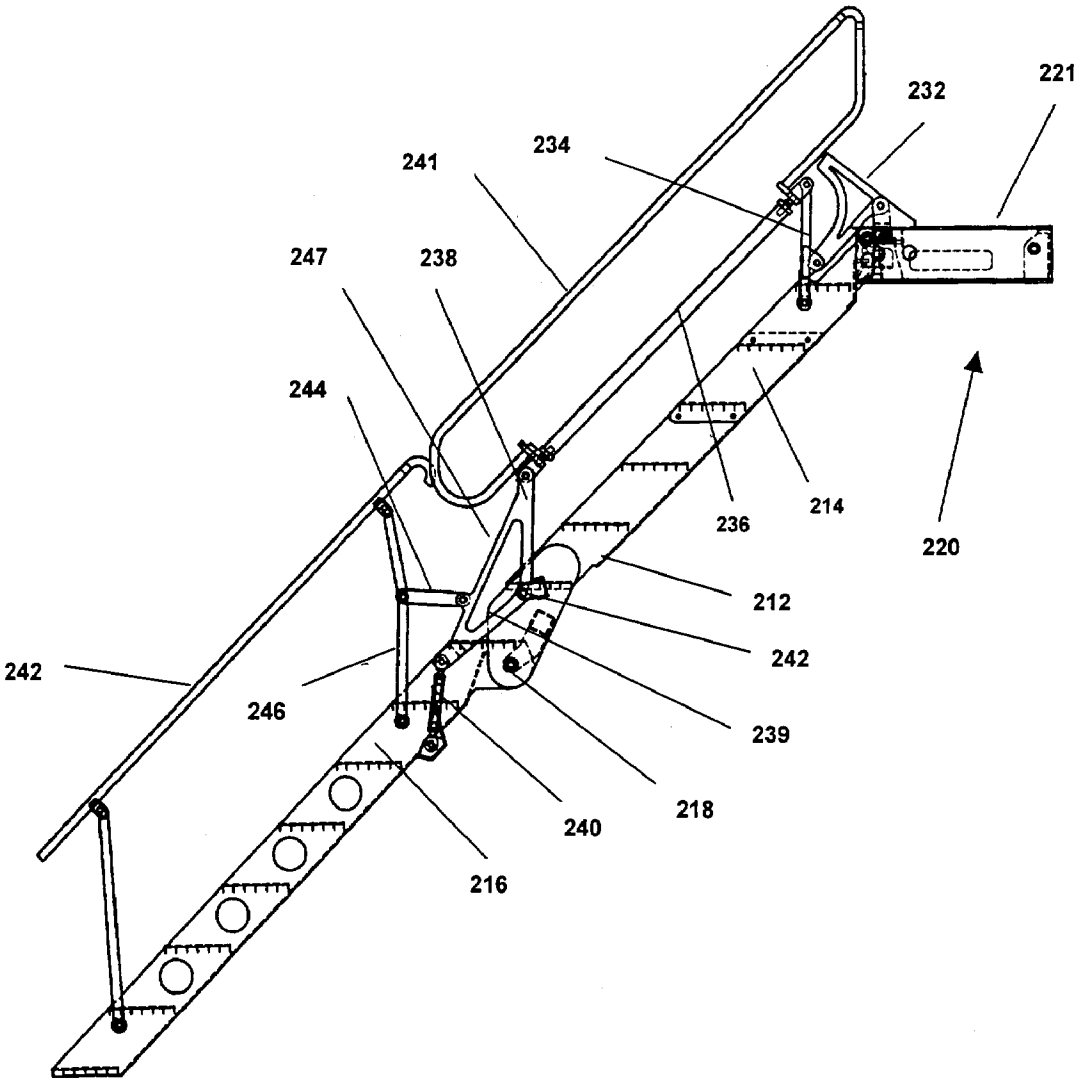
FIG. 2 is a schematic side elevation of the device shown in FIG. 1.
Figure 3:
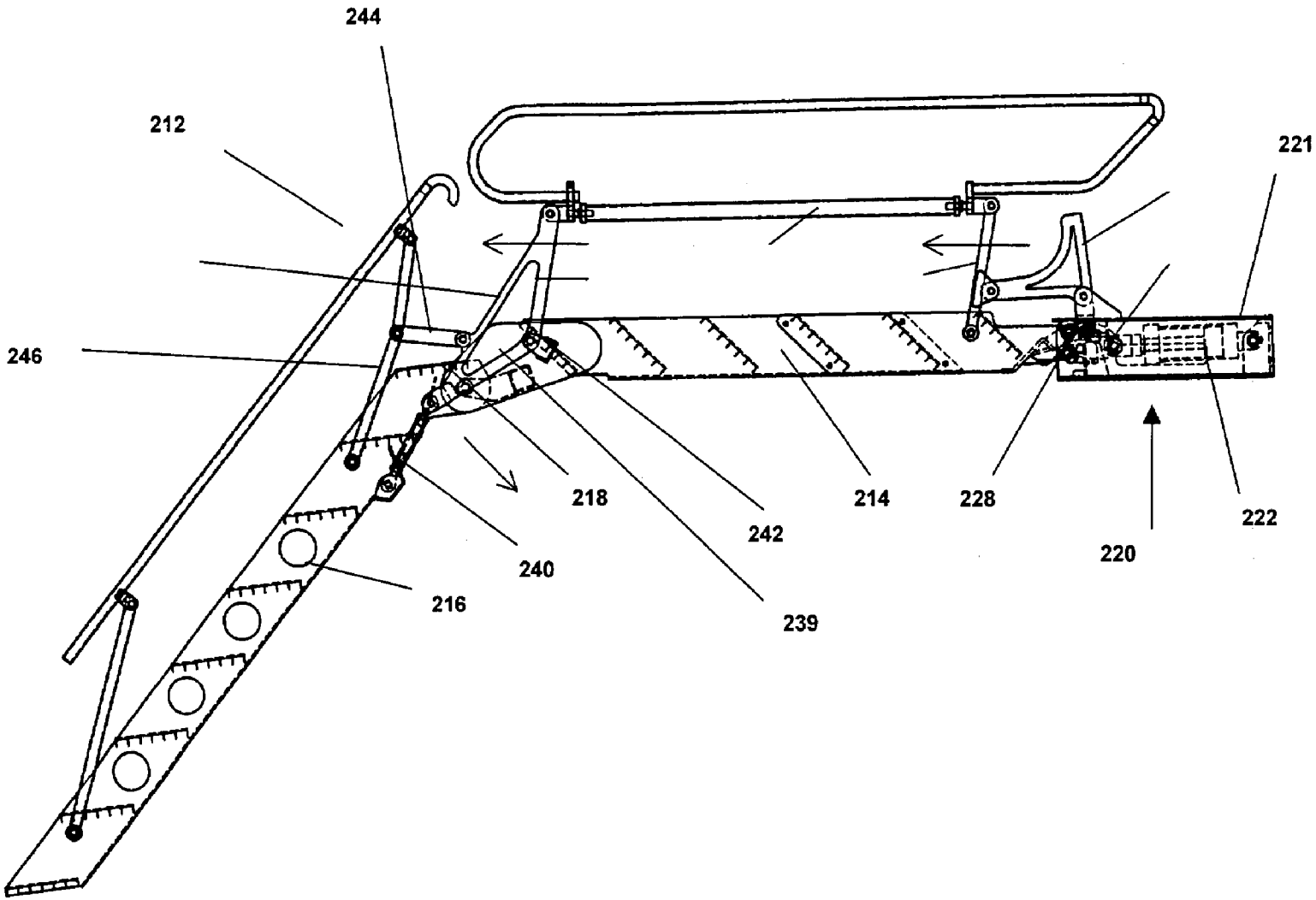
FIG. 3 is a similar view to FIG. 2 with the device in an intermediate position.
Figure 4:
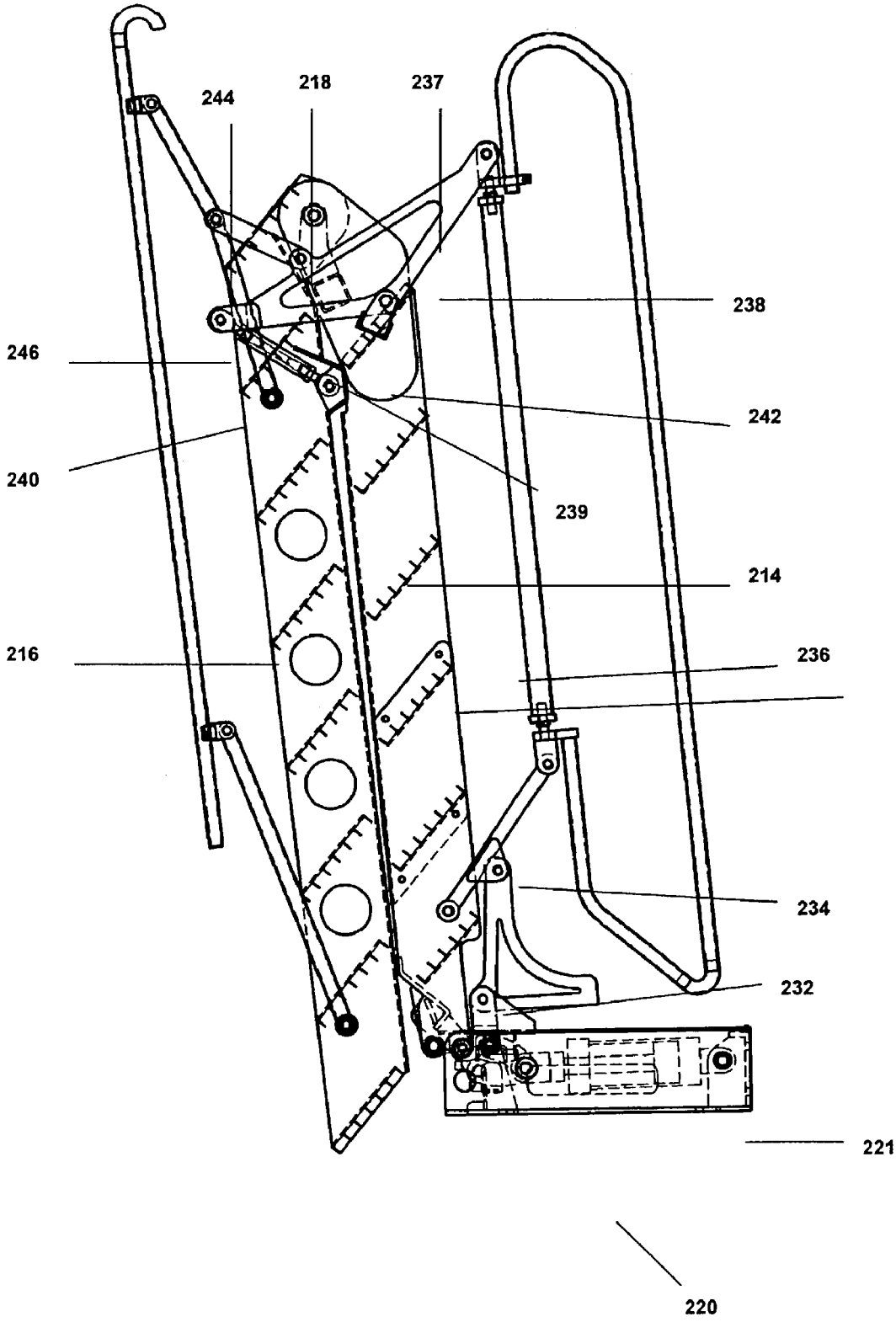
FIG. 4 is a similar view to that of FIGS. 2 and 3 with the device in a stored and retracted position.
Figure 1:
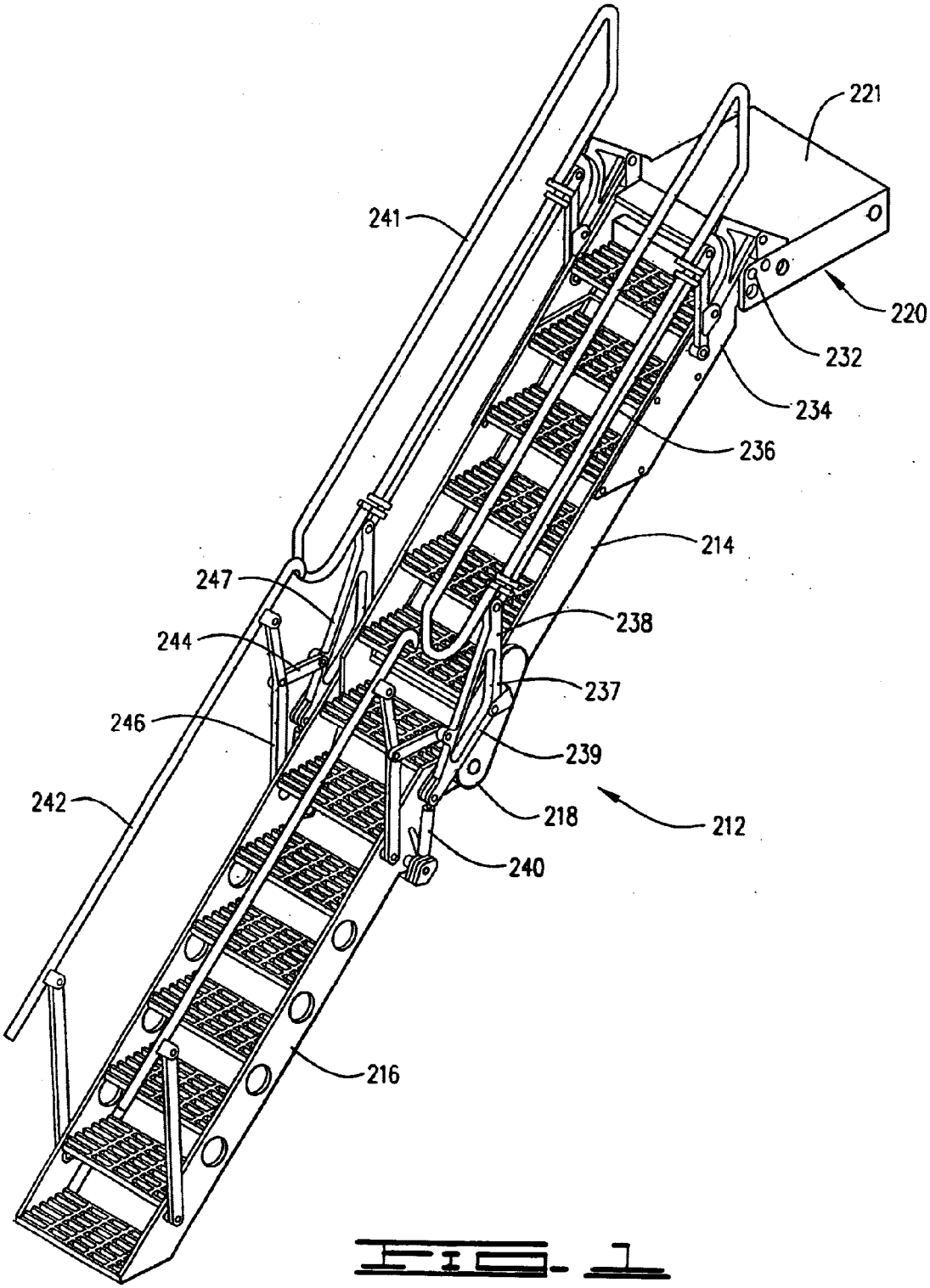
Figure 2:
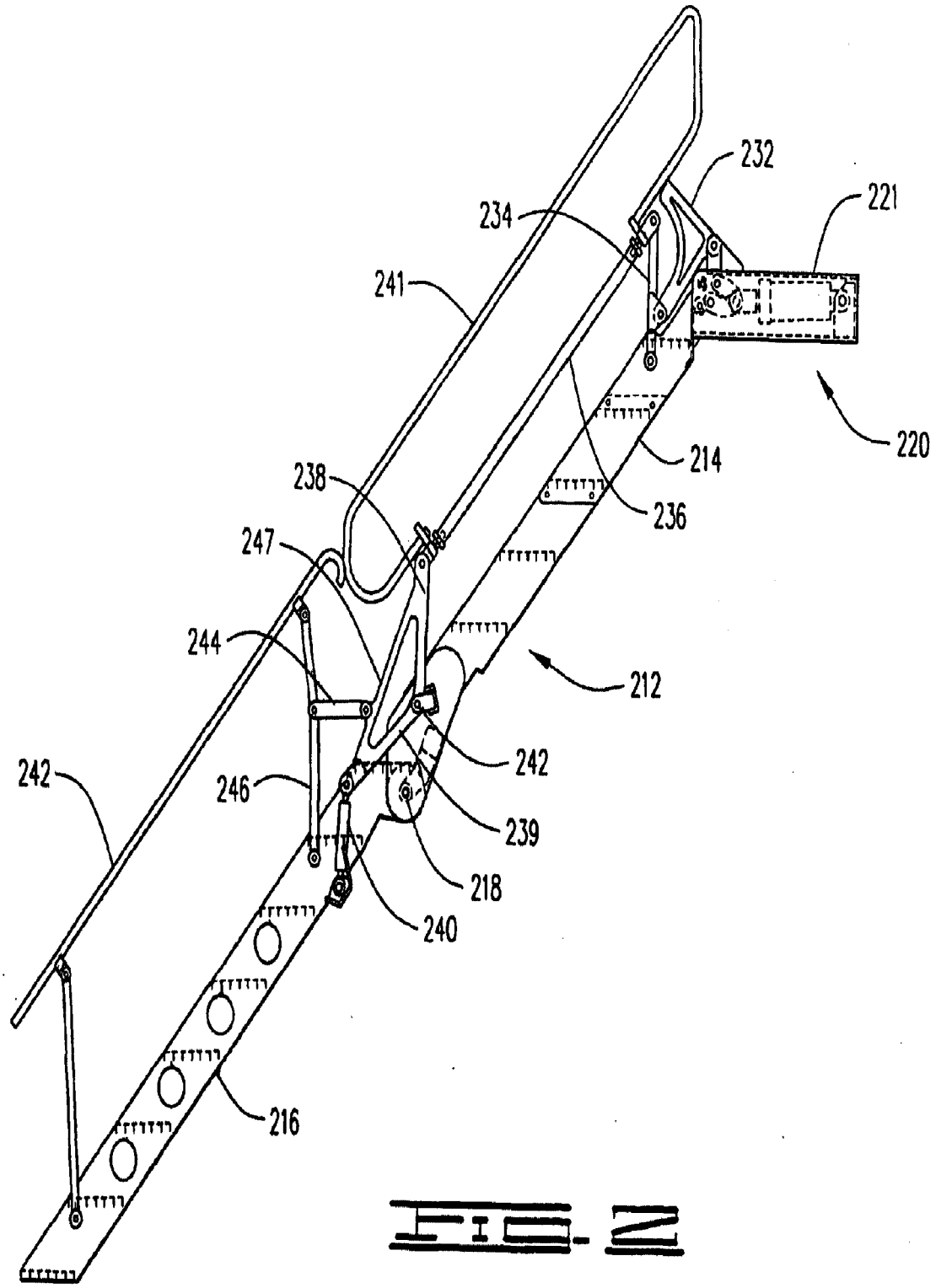
Figure 3:
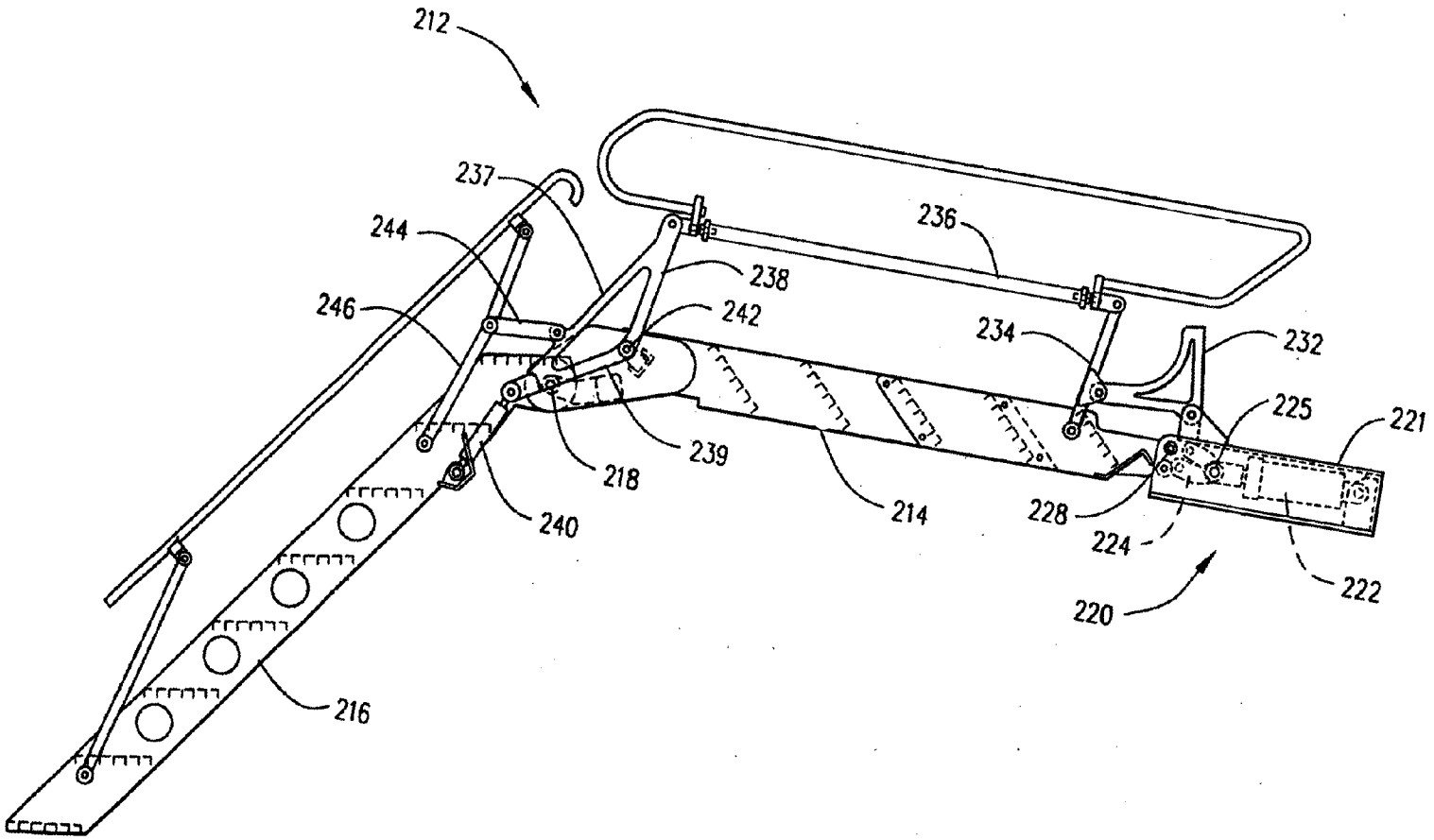
Figure 4:
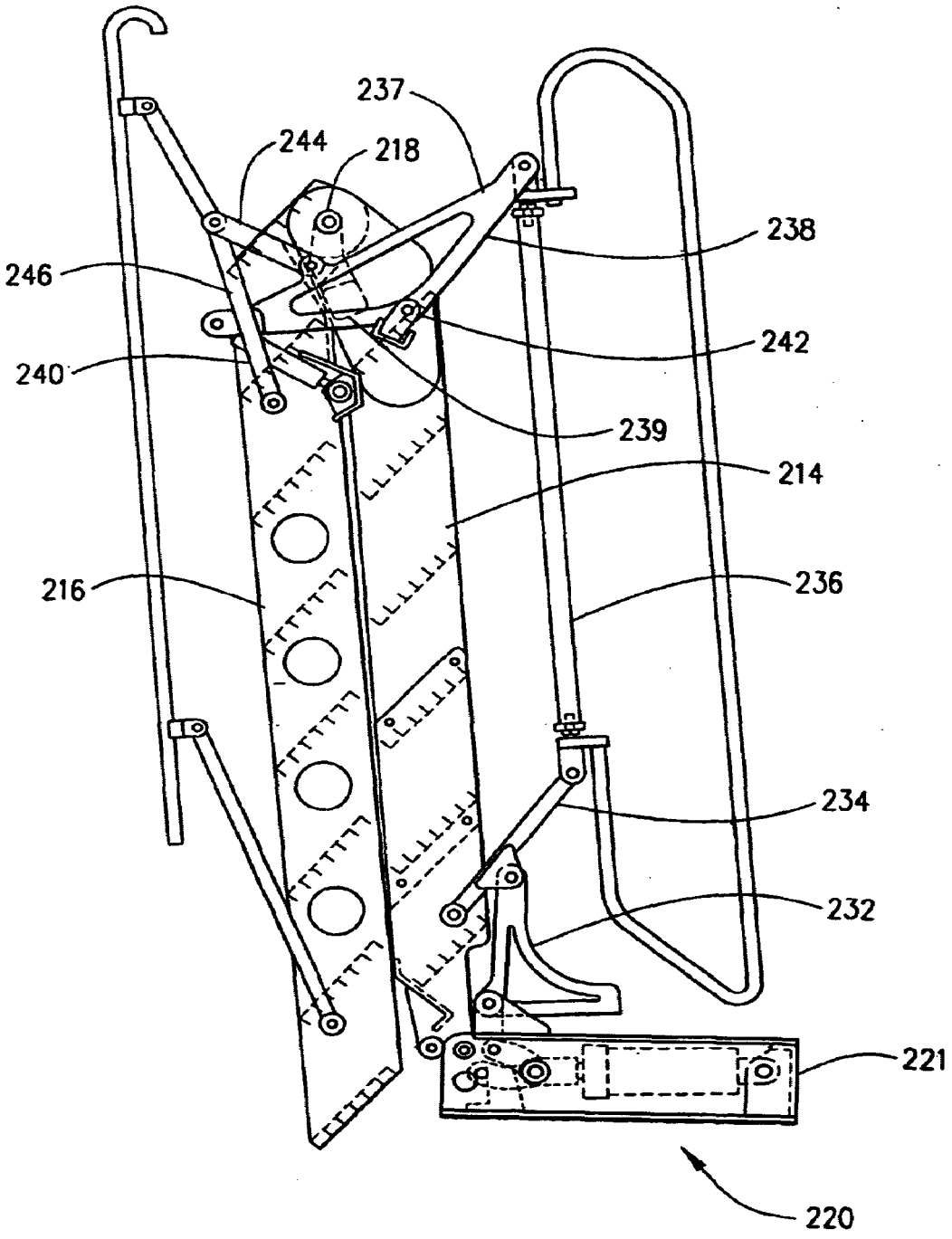

Referring to the drawings the access device generally indicated at 210 includes a stairway 212 comprising an upper section 214 and a lower section 216. The upper and lower sections are pivotally connected together via pivot mounting 218 so that the two parts can pivot relative to one another between a fully extended as shown in FIGS. 1 and 2 and fully retracted or folded position as shown in FIG. 4.

The drive mechanism 220 comprises a support frame 221, the upper section of the stairway being pivotally mounted to the support frame. The drive mechanism further includes a linear actuator 222, and a drive link mechanism 224 which includes a control link 225 and a coupling link 228. This drive mechanism is substantially the same and acts in the same fashion as has been described in the earlier Patent Specification 738307 (48282/97).

There is further provided a stairway control link assembly which is duplicated on both sides of the stairway and which includes a motion generating link 232 which is pivotally mounted to the support frame 221 and is operatively connected to drive and control link mechanism for moving the stairway between the access and stowed positions, the link 232 being moved in response to movement of the stairway by the drive and control link mechanism. The control link assembly further includes a first transfer link assembly including first transfer link 234 to which the motion generating link 232 is operatively connected. A second transfer link 236 has one end connected to link 234 with the other end being operatively connected to coupling link 237. The coupling link 237 is pivotally connected to the upper section 214 of the stairway at pivot point 242.

The coupling link 237 comprises two arms 238 and 239 and a cross member 247. Arm 238 forms part of a four bar link mechanism comprising links 234 and 236 as well as arm 238. The other arm 239 of the coupling link is operatively connected to the lower section 216 of the staircase via an adjustable link 240, similar to a turnbuckle.

The handrail for the upper section 214 of the staircase is connected to the linkage formed by arm 238 and links 234 and 236. The handrail for the lower section 216 of the staircase is connected to the coupling link 237 via transfer links 244 and 246 which form a second transfer link assembly.

In operation actuation of the primary linear actuator 222 causes pivotal movement of the stairway as described in the earlier patent specification. The pivotal movement of the stairway causes a pivotal movement of the link assembly comprising links 232, 234, 236 and coupling link 237 in the direction of the arrows as shown. This pivotal movement causes pivotal movement of the lower section 216 of the stairway 212 relative to the upper section 214. When the coupling link has reached a selected position, the adjustable link 240 causes the lower section to fully retract the lower section 216 of the stairway relative to the upper section 214.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that the prior art forms part of the common general knowledge in Australia.

Finally, it is to be understood that various alterations, modifications and/or additions may be incorporated into the various constructions and arrangements of parts without departing from the spirit or ambit of the invention.

The claims defining the invention are as follows:

1. An access device for providing access between a lower level and an upper level, the access device including a main body which includes an upper section and a lower section which is pivotally connected to the upper section, the upper section being mounted for pivotal movement about an upper section fixed pivot mounting between an access position and a stowed position, the device further including a drive mechanism operable to cause movement of the upper section between the access and stowed positions, the upper and lower body sections being pivotally movable relative to one another between an extended position in which they are disposed generally end to end and a retracted position in which they are disposed generally side by side in a folded configuration such that the upper and lower body sections are positioned substantially vertically or at a rearwardly inclined angle in a position which is upward and rearward of the upper level, the device further including a control link assembly for controlling the movement of the upper and lower sections between the extended and retracted positions, the control link assembly being movable in response to movement of the upper section between the access and stowed positions and including a motion generating link operatively mounted for pivotal movement in response to movement of the upper section between the access and stowed positions, the motion generating link being operatively connected to the drive mechanism, the control link assembly further including a first transfer link assembly operatively connected to the motion generating link and being movable by the motion generating link in response to movement of the upper section between the access and stowed positions, the first transfer link assembly including a first link member having one end portion pivotally connected to the upper section of the main body, and a second link member operatively connected to the first link member in spaced relation to the aforementioned one end thereof, and wherein the control link assembly further includes a coupling link pivotally mounted to the upper section of the main body and operatively connected to the first transfer link assembly and a second transfer link assembly operatively connected to the coupling link and the lower section of the main body, and wherein the first and second link members, the coupling link and a portion of the upper section of the main body form a four bar linkage, the first link member being operatively connected to the motion generating link, and wherein the coupling link includes two arms which extend away from one another from a junction region, one of the arms being connected to the second link member, the two arms forming a generally V-shaped configuration, with a cross arm extending between the two arms in spaced relationship from the junction region, and wherein the second transfer link assembly includes a third link member and a fourth link member, the third link member being connected between the coupling link and the fourth link member which in turn is operatively connected to the lower section of the main body, and wherein the device further includes adjustable link means which is operatively connected between the coupling link and the lower section of the main body so as to urge it towards either the fully extended or retracted positions, the adjustable link means including an elongated element, one end of which is operatively connected to the lower section of the main body and the other end is operatively connected to the other arm of the coupling link.

* * * * *

UNITED STATES PATENT AND TRADEMARK OFFICE

CERTIFICATE OF CORRECTION

PATENT NO. : 6,981,572 B2
DATED : January 3, 2006
INVENTOR(S) : Robert Ian Hedley It is certified that error appears in the above-identified patent and that said Letters Patent is hereby corrected as shown below:

The title page should be deleted to appear as per attached title page.

The sheets of drawings consisting of figures 1-4 should be deleted to appear as per attached figures.

Title page,
Item [75], Inventor, add -- New South Wales (AU) -- after "Singleton (AU)".

Signed and Sealed this

Sixth Day of June, 2006

JON W. DUDAS
*Director of the United States Patent and Trademark Office*

(12) United States Patent
Hedley

(10) Patent No.: US 6,981,572 B2
(45) Date of Patent: Jan. 3, 2006

(54) FOLDABLE ACCESS DEVICE

(75) Inventor: Robert Ian Hedley, Milbrodale Via Singleton (AU)

(73) Assignee: Hedweld Engineering Pty Ltd., New South Wales (AU)

( * ) Notice: Subject to any disclaimer, the term of this patent is extended or adjusted under 35 U.S.C. 154(b) by 0 days.

(21) Appl. No.: 10/359,971

(22) Filed: Feb. 7, 2003

(65) Prior Publication Data

US 2003/0173153 A1 Sep. 18, 2003

(30) Foreign Application Priority Data

Feb. 8, 2002 (AU) ..... PS0404/02

(51) Int. Cl.
*E06C 5/00* (2006.01)

(52) U.S. Cl. ..... 182/95; 182/127
(58) Field of Classification Search ..... 182/95, 182/84, 83, 85, 86, 89, 127; 280/166; 14/69.5; 192/97
See application file for complete search history.

(56) References Cited

U.S. PATENT DOCUMENTS

| | | | | |
|---|---|---|---|---|
| 2,531,263 | A * | 11/1950 | Fink et al. | 182/97 |
| 2,933,149 | A * | 4/1960 | Royal | 182/78 |
| 4,014,486 | A * | 3/1977 | Nelson et al. | 244/129.6 |
| 4,068,770 | A * | 1/1978 | Boehringer | 414/537 |
| 6,068,277 | A * | 5/2000 | Magnussen | 280/166 |

* cited by examiner

*Primary Examiner*—Alvin Chin-Shue
(74) *Attorney, Agent, or Firm*—McAfee & Taft

(57) ABSTRACT

An access device for providing access between a lower level and an upper level, the access device including a main body which includes a first body section and a body section pivotally connected to the first body section, said first section being mounted for pivotal movement about a main body fixed pivot mounting between an access position and a stowed position, a drive mechanism operable to cause movement of the first body section between the access and stowed positions, the first and second body sections being pivotally movable between an extended position in which they are disposed generally end to end and a retracted position in which they disposed generally side by side, and a control link assembly for controlling the movement of the first and second body sections between the extended and retracted positions.

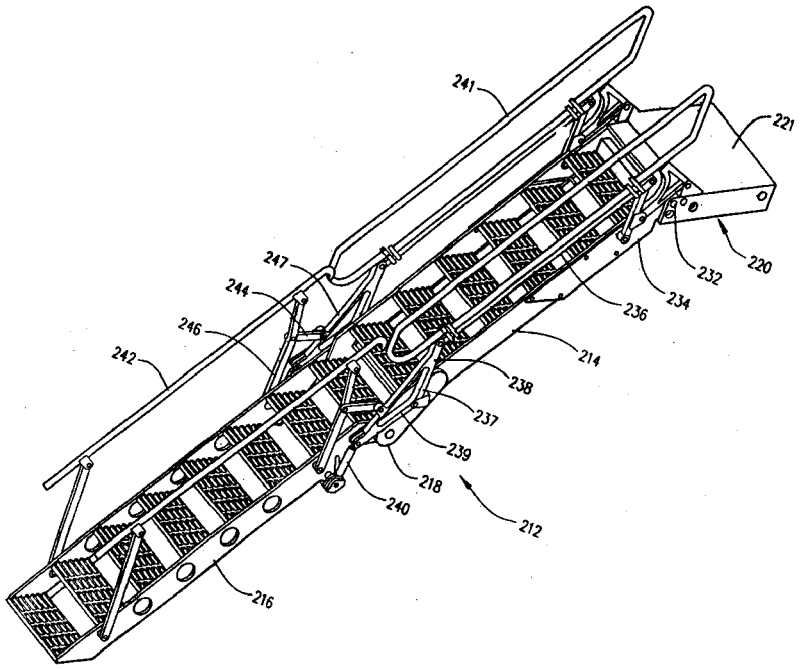

1 Claim, 4 Drawing Sheets